US012043926B2

(12) United States Patent
De Vries et al.

(10) Patent No.: US 12,043,926 B2
(45) Date of Patent: Jul. 23, 2024

(54) OPTIMIZING A SPINNING PROCESS WITH RESPECT TO FOREIGN MATERIALS

(71) Applicant: Uster Technologies AG, Uster (CH)

(72) Inventors: Loris De Vries, Gossau (CH); Ulf Schneider, Uster (CH); Oswald Baldischwieler, Wutoschingen (DE); Pavel Pliska, Zurich (CH)

(73) Assignee: Uster Technologies AG, Uster (CH)

( * ) Notice: Subject to any disclaimer, the term of this patent is extended or adjusted under 35 U.S.C. 154(b) by 391 days.

(21) Appl. No.: 17/310,011

(22) PCT Filed: Jan. 23, 2020

(86) PCT No.: PCT/CH2020/000002
§ 371 (c)(1),
(2) Date: Jul. 9, 2021

(87) PCT Pub. No.: WO2020/154820
PCT Pub. Date: Aug. 6, 2020

(65) Prior Publication Data

US 2022/0090302 A1 Mar. 24, 2022

(30) Foreign Application Priority Data

Jan. 31, 2019 (CH) ..... 00106/19
Feb. 8, 2019 (CH) ..... 00158/19

(51) Int. Cl.
*D01G 31/00* (2006.01)

(52) U.S. Cl.
CPC ..... *D01G 31/003* (2013.01)

(58) Field of Classification Search
CPC ..... D01G 31/003; D01H 13/22
See application file for complete search history.

(56) References Cited

U.S. PATENT DOCUMENTS 4,512,060 A 4/1985 Shofner
4,653,153 A 3/1987 Felix et al.
(Continued)

FOREIGN PATENT DOCUMENTS

CH 708392 A2 1/2015
DE 19505421 A1 8/1996
(Continued)

OTHER PUBLICATIONS

"The origins of fabric defects—and ways to reduce them," Uster News Bulletin No. 47, Sec. 3.8, Uster Technologies AG, Mar. 2010.
(Continued)

*Primary Examiner* — Bao-Thieu L Nguyen
(74) *Attorney, Agent, or Firm* — TechnicalAttorney; Rick Barnes

(57) ABSTRACT

The invention relates to a method for optimizing a spinning process, through which a fiber material fed in the form of raw fibers and output in the form of yarn passes, with respect to foreign materials. At a first position in the spinning process, a first foreign material information relating to the foreign materials is determined. At a second position in the spinning process, which is downstream with respect to the first position, a second foreign material information relating to the foreign materials is determined. The first foreign material information and the second foreign material information are associated with each other such that they relate to substantially the same sample of the fiber material. Based on the first foreign material information and the second foreign material information assigned thereto, a change is made to the spinning process to optimize the spinning process.

15 Claims, 5 Drawing Sheets

(56) References Cited

U.S. PATENT DOCUMENTS 5,007,136 A * 4/1991 Artzt ..... D01G 21/00 19/65 A
5,052,080 A * 10/1991 Grundler ..... D01G 23/06 19/65 A
5,381,340 A * 1/1995 Ueda ..... D01G 31/006 700/109
5,383,135 A * 1/1995 Shofner ..... D01G 31/003 702/128
5,539,515 A * 7/1996 Shofner ..... G01N 15/0205 73/160
5,598,266 A * 1/1997 Cornuejols ..... D01G 31/00 250/559.46
5,752,294 A * 5/1998 Mor ..... D01G 31/006 250/559.19
5,799,476 A * 9/1998 Bahlmann ..... D01H 13/22 57/263
5,805,452 A * 9/1998 Anthony ..... G05B 13/026 700/142
5,822,972 A * 10/1998 Patelke ..... D01G 31/003 57/311
5,834,639 A * 11/1998 Meier ..... D01H 13/22 73/159
5,892,142 A * 4/1999 Ghorashi ..... G01N 33/362 73/38
6,244,030 B1 6/2001 Arb et al.
6,421,883 B1 * 7/2002 Staheli ..... D01G 13/00 19/205
6,983,516 B2 1/2006 Dammig et al.
7,684,033 B2 3/2010 Engels et al.
2001/0049860 A1 * 12/2001 Jossi ..... D01B 3/025 19/65 A
2002/0078532 A1 * 6/2002 Hosel ..... D01G 31/003 19/107
2002/0108216 A1 * 8/2002 Foster ..... D01G 13/00 19/145.5
2002/0152583 A1 * 10/2002 Bischofberger ..... D01G 31/006 19/98
2004/0194257 A1 10/2004 Dammig et al.
2004/0195156 A1 * 10/2004 Losbrock ..... D01G 31/003 209/643
2008/0129989 A1 6/2008 Engels et al.
2015/0377854 A1 * 12/2015 Gaynor ..... G01N 33/365 252/301.36
2019/0137382 A1 5/2019 Nasiou et al.

FOREIGN PATENT DOCUMENTS

DE 19627194 A1 3/1997
DE 29622931 U1 9/1997
EP 0877104 A1 11/1998
EP 1057907 A1 12/2000
EP 3587637 A1 1/2020
GB 2444404 A 6/2008
WO 2006079426 A1 8/2006
WO 2017079853 A1 5/2017

OTHER PUBLICATIONS

Uster Jossi Vision Shield 2—The key to Total Contamination Control, Uster Technologies AG, Oct. 2015.
Jster Quantum 3 Application Handbook, Sec. 8.4, Uster Technologies AG, Apr. 2011.
Biermann, "Contamination Control in Spinning," Unpublished, as far as applicant is aware.

* cited by examiner

OPTIMIZING A SPINNING PROCESS WITH RESPECT TO FOREIGN MATERIALS

TECHNICAL FIELD

The present invention is in the field of yarn spinning. It relates to a method for optimizing a spinning process with respect to foreign materials and to a device for carrying out the method, according to the independent patent claims.

STATE OF THE ART

Foreign materials in the yarn represent one of the major problems of today's spinning mills. These are materials that differ from the intended base material of the yarn fibers, e.g. cotton fibers. They can be of various origins, such as plastic packaging, cords, human or animal hair, etc. Foreign materials cause yarn breaks during spinning and weaving, take dye in a different way than the base material and affect the appearance of the final textile product. They significantly reduce the value of the final product. An overview of fabric defects caused by foreign materials and recommendations for their reduction is given in Sec. 3.8 of USTER® *NEWS BULLETIN NO.* 47 "The origins of fabric defects—and ways to reduce them", Uster Technologies AG, March 2010.

WO-2006/079426 A1 discloses a method and a device for separating foreign substances in fiber material, in particular in raw cotton. Such methods are used, for example, in the blow room to prepare the raw cotton for spinning. The fiber material is fed in a pneumatic fiber transport line one after the other past a sensor system and a separation device. When foreign materials are detected by the sensor system, they are removed from the fiber transport line by means of a compressed air pulse directed transversely to the fiber transport line through a removal opening in the fiber transport line. A corresponding product is described in the brochure "USTER® *JOSSI VISION SHIELD* 2—The key to Total Contamination Control", Uster Technologies AG, October 2015.

Further downstream in the textile manufacturing process, foreign materials can be removed from the yarn on spinning or winding machines by so-called yarn clearers. A yarn clearer contains a measuring head having at least one sensor that scans the moving yarn and detects yarn defects such as foreign materials or thick and thin places. The output signal from the sensor is continuously evaluated according to predetermined criteria. U.S. Pat. No. 6,244,030 B1 discloses a yarn clearer that not only detects foreign materials, but also distinguishes between different types of foreign materials. The sensor optically scans the yarn by incident light. A classifying field or matrix is provided. Along the horizontal axis of the classifying field, the length of yarn sections is plotted, and along the vertical axis, the reflectivity of light on the yarn is plotted. The classifying field is divided into 16 classes for light foreign materials and 16 classes for dark foreign materials. Yarn sections of the same class are counted. A corresponding product is described in the brochure "USTER®*QUANTUM* 3 Application Handbook", Sec. 8.4, Uster Technologies AG, April 2011.

WO-2017/190259 A1 describes a method and device for monitoring impurities in a fiber flock stream. In one embodiment, a first monitoring device monitors impurities in a fiber flock stream, while a second monitoring device monitors impurities downstream in the textile manufacturing process. The second monitoring device may be a yarn clearer on a winding machine. A control unit is connected to the first and second monitoring devices. It collects data from the two monitoring devices, evaluates said data statistically, and outputs reports produced therefrom to an operator. In a control loop, a contaminant removal limit in the first monitoring device is changed depending on a monitoring result from the second monitoring device.

U.S. Pat. No. 4,653,153A describes control devices for drawing processes in auto leveler draw frames in the textile industry. They can operate according to the principle of open or closed loop control in order to obtain a sliver with a uniform cross-section at the exit of the drawing frame. The measuring signal of a fast reacting measuring element at the outlet of the draw frame is correlated with another measuring signal at the inlet of the draw frame. In this way, the parameters governing the drafting value are corrected in such a way that even short-term cross-sectional fluctuations of the sliver are compensated. In particular, the running time of the sliver from the actuator to the measuring element at the outlet of the draw frame as well as the total amplification of the measuring signal are decisive.

SUMMARY OF THE INVENTION

It is an object of the present invention to disclose a method that optimizes a spinning process with respect to foreign materials. The optimization shall in particular concern the yarn quality and/or the production costs: The yarn quality is to be increased at the same production costs, the production costs are to be reduced at the same yarn quality, or the yarn quality is to be increased and the production costs are to be reduced at the same time. In the context of foreign materials, a higher yarn quality means a lower proportion of interfering foreign materials in the yarn. Production costs are influenced, among other things, by the amount of fiber material rejected as waste and the frequency of winding machine stops.

It is a further object of the invention to provide a device for carrying out the method.

These and other objects are solved by the method and device according to the invention, as defined in the independent claims. Advantageous embodiments are indicated in the dependent claims.

The invention is based on the idea of assigning foreign material information determined at two different positions in the spinning process to each other and making a change to the spinning process based on the assigned foreign material information. The assigning must be such that the foreign material information relates to substantially the same sample of the fiber material.

As used in this specification, the term "sample" means a related quantity of the fiber material having substantially the same, substantially homogeneously distributed properties. The size of the sample may range from a fiber flock having a mass of less than 1 g to several tons of fiber material. An example of a sample is a lay-down of 50 cotton bales of 220 kg each (total 11 t), as encountered in an opening department. The sample passes through the spinning process; its structure and shape change depending on the particular process step. The same sample can, for example, take the form of raw fibers, fiber flocks, nonwoven, sliver, roving or yarn. The sample can be divided among different processing machines during the spinning process.

The method according to the invention is used to optimize a spinning process, which is run through by a fiber material fed in the form of raw fibers and output in the form of yarn, with respect to foreign materials in the fiber material. At a first position in the spinning process, a first foreign material information relating to the foreign materials is determined.

At a second position in the spinning process, which is downstream with respect to the first location, second foreign material information relating to the foreign materials is determined. The first foreign material information and the second foreign material information are assigned to each other such that they relate to substantially the same sample of the fiber material. Based on the first foreign material information and the second foreign material information assigned thereto, a change is made to the spinning process.

The first position and the second position preferably corresponds to one process step each from the following set: opening, coarse cleaning, blending, fine cleaning, carding, doubling, combing, drafting, spinning, rewinding.

The determination of the first foreign material information and/or the second foreign material information can be performed on the entire sample of the fiber material or on a subset of the sample of the fiber material. It can be carried out continuously or at discrete points in time. It can be performed online at the spinning process or offline by taking the sample of the fiber material or a subset thereof from the spinning process and examining it outside the spinning process, e.g. in a textile laboratory.

The change to the spinning process may include a change to the raw fibers fed into the spinning process, or at least a portion thereof, and/or a change to settings on machinery involved in the spinning process.

The mutual assignment of the first foreign material information and the second foreign material information preferably includes one of the steps from the following set: determining a passage time as that interval of time during which a fiber passes from the first position to the second position in the spinning process; determining a property of the sample itself; and marking a carrier of the sample. The passage time may be determined empirically or theoretically from known processing and storage times. For example, the property of the sample may be its chemical composition, which may include the natural composition of the fiber via genetic analysis and/or an artificially added marking (marker). Depending on the sample properties, carriers of the sample can be cans or bobbin cores to which optical and/or electromagnetic markings are applied.

In a preferred embodiment, a stream of fiber flocks pneumatically conveyed in an air stream is monitored for foreign materials at the first position in the spinning process. Based on the monitoring, the first foreign material information is determined. At the second position in the spinning process, yarn spun from the fiber flocks and conveyed along its longitudinal direction is monitored for foreign materials. Based on the monitoring, the second foreign material information is determined. A passage time is determined as that interval of time during which a fiber passes from the first position to the second position in the spinning process. The first foreign material information is determined at a first time, and the second foreign material information is determined at a second time, which is after the first time by the passage time. The first foreign material information thus determined and the second foreign material information thus determined are assigned to each other.

In one embodiment, the first foreign material information is a first foreign material fraction indicating a proportion of foreign materials in the fiber flocks, and the second foreign material information is a second foreign material fraction indicating a proportion of foreign materials in the yarn. Preferably, the first foreign material fraction indicates substantially a number of foreign materials per unit mass of fiber flocks or per unit time, and/or the second foreign material fraction indicates substantially a number of foreign materials per unit mass of yarn, per unit length of yarn, or per unit time.

In one embodiment, foreign materials are removed from the stream of fiber flocks at the first position in the spinning process according to a removal criterion, and the change to the spinning process includes a change to the removal criterion. The first foreign material information can be a removal rate, which essentially indicates a number of removals per unit mass of fiber flocks or per unit time. Advantageously, a correlation between the removal criterion and the removal rate is determined in advance, and this correlation is taken into account in the change to the spinning process.

In one embodiment, foreign materials detected in the yarn at the second position in the spinning process are cleared out of the yarn according to a clearing criterion, and the change to the spinning process includes a change to the clearing criterion. Preferably, the second foreign material information is a clearing rate that substantially indicates a number of clearing operations per unit mass of yarn, per unit length of yarn, or per unit time. Preliminarily, a correlation between the clearing criterion and the clearing rate may be determined, and this correlation may be taken into account in the change to the spinning process. Preliminarily, a cost of a removal may be determined and a product of the cost of a removal and the removal rate may be considered in the change to the spinning process. Preliminarily, costs for a clearing operation may be determined and a product of the costs for a clearing operation and the clearing rate may be considered in the change to the spinning process. It may be advantageous to consider in the change to the spinning process a linear combination of the product of the cost for a removal and the removal rate, and the product of the cost of a clearing operation and the clearing rate. The change to the spinning process is advantageously made in such a way that the linear combination assumes a smaller value after the change than before the change, and preferably in such a way that a global minimum of the linear combination is reached.

The passage time can be entered manually by an operator, calculated automatically based on specifications, and/or retrieved from a database based on specifications.

In one embodiment, first classes of foreign materials in the fiber material are predetermined at the first position, which first classes differ from each other with respect to properties of the foreign materials, and the first foreign material information relates to one or more of these first classes. Likewise, second classes of foreign materials may be predetermined in the fiber material at the second position, which second classes differ from each other with respect to properties of the foreign materials, and the second foreign material information may relate to one or more of these second classes.

In one embodiment, the first foreign material information and the second foreign material information are output simultaneously to an operator. The simultaneous output of the first foreign material information and the second foreign material information may occur at least partially graphically. In addition to the simultaneous output of the first foreign material information and the second foreign material information, an evaluation of the first foreign material information and/or the second foreign material information may be output to the operator. Preferably, the evaluation includes at least two categories, each indicating appropriate or critical foreign material information. In addition to the simultaneous output of the first foreign material information and the second foreign material information, a recommendation for the change to the spinning process may be output to the operator.

In one embodiment, an alarm is output to an operator based on the first foreign material information and the second foreign material information assigned thereto. Preferably, a time course of the first foreign material information and a time course of the second foreign material information assigned thereto are determined, and the alarm is output based on the time courses.

In one embodiment, the operator makes the change to the spinning process based on the simultaneously output first foreign material information and second foreign material information, based on the evaluation, and/or based on the recommendation.

In one embodiment, the change is made to the spinning process automatically.

In one embodiment, a global frequency distribution of a foreign material content in fiber flocks and/or in yarns is determined in advance, and this frequency distribution is taken into account in the change to the spinning process.

The invention also relates to a device for carrying out the method according to the invention in a spinning mill carrying out a spinning process through which a fiber material fed in the form of raw fibers and discharged in the form of yarn passes. The device includes a first monitoring device at a first position in the spinning process. The first monitoring device is adapted to determine a first foreign material information relating to the foreign materials. Further, the device includes a second monitoring device at a second position in the spinning process that is downstream with respect to the first position. The second monitoring device is adapted to determine second foreign material information relating to the foreign materials. The device further includes a central control device connected to the first monitoring device and the second monitoring device. The central control device is adapted to assign the first foreign material information and the second foreign material information to each other, and to automatically make a change to the spinning process based on the first foreign material information and the second foreign material information assigned thereto, and/or to output the first foreign material information and the second foreign material information simultaneously to an operator.

In one embodiment, the device includes a fiber flock monitoring device at the first position in the spinning process. The fiber flock monitoring device is adapted to monitor a stream of fiber flocks pneumatically conveyed in an air stream for foreign materials and to determine the first foreign material information based on the monitoring. Further, the device includes yarn monitoring device at the second position in the spinning process. The yarn monitoring device is adapted to monitor yarn spun from the fiber flocks and conveyed along its longitudinal direction for foreign materials, and to determine the second foreign material information based on the monitoring. The central control device is adapted to store a passage time as that time interval during which a fiber passes from the first position to the second position in the spinning process, to store the first foreign material information at a first time point and the second foreign material information at a second time point which is after the first time point by the passage time, and to assign the first foreign material information thus determined and the second foreign material information thus determined to each other.

Thanks to the invention, the spinning process is optimized with regard to foreign materials. A high yarn quality is achieved because few foreign materials remain in the yarn. At the same time, productivity is high because little fiber material is rejected as waste.

BRIEF DESCRIPTION OF THE DRAWINGS

In the following, the invention is explained in detail with reference to the drawings.

Predominantly, a preferred embodiment is discussed in which the first position in the spinning process corresponds to the fine cleaning of fiber flocks and the second position in the spinning process corresponds to the rewinding of yarn. However, this is not intended to limit the generality of the invention. Alternatively, the first and/or the second position may correspond to other process steps.

DETAILED DESCRIPTION OF THE PREFERRED EMBODIMENTS

Figure 1:
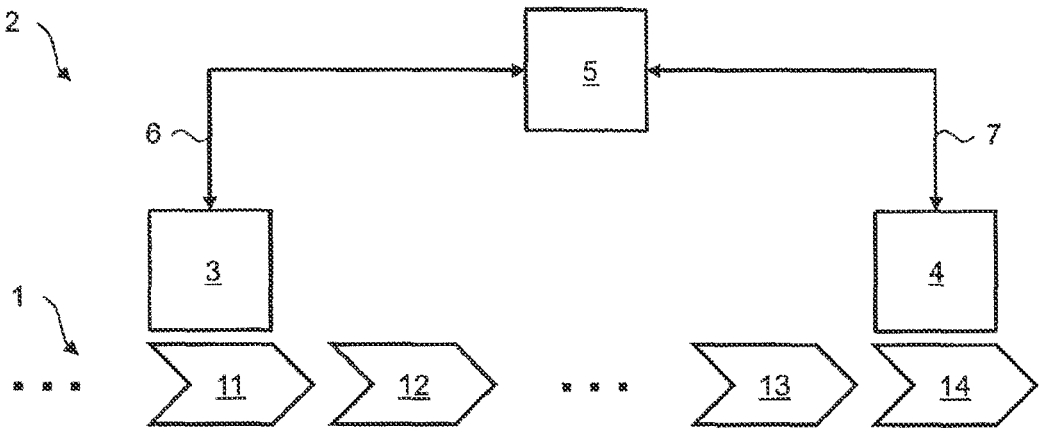
FIG. 1 schematically shows part of a spinning process in a spinning mill and a device according to the invention.

FIG. 1 schematically shows a part of a spinning process 1 that takes place in a spinning mill. In the spinning process 1, yarn is spun from raw cotton, for example. The spinning process 1 may include, for example, the following process steps: opening, coarse cleaning, blending, fine cleaning 11, carding 12, doubling, combing, drafting, spinning 13, rewinding 14. Not all of the mentioned process steps 11-14 need to be passed through, and further process steps may be added. For the sake of simplicity, only a few process steps 11-14 are schematically drawn in FIG. 1, while others are indicated by dots.

FIG. 1 also shows a schematic drawing of a device 2 according to the invention. At a first position at an early stage in the spinning process 1, e.g. in or immediately after the fine cleaning 11, there is a stream of fiber flocks which are pneumatically conveyed in an air stream. At this first position, a fiber flock monitoring device 3 of the device 2 according to the invention is located. The fiber flock monitoring device 3 is arranged to monitor the flow of fiber flocks for foreign materials and, based on the monitoring, to determine a first foreign material information relating to the foreign materials.

The first foreign material information may be a first foreign material fraction indicating a proportion of foreign materials in the fiber flocks. This can be, for example, essentially a number of foreign materials per unit mass of fiber flocks (e.g., per 100 kg) or per unit time (e.g., per hour); the two pieces of information can be converted into each other using the usually known mass flow per unit time (e.g., in kg/h).

Furthermore, the fiber flock monitoring device 3 can remove foreign materials from the stream of fiber flocks according to a removal criterion. A method and a device for removing foreign materials in fiber material, in particular in raw cotton, are known per se, for example, from WO-2006/079426 A1. In a preferred embodiment, the fiber flock monitoring device 3 includes a sensor system that detects properties of objects, including foreign matter, in the stream of fiber flocks. For example, the sensor system may include two CCD cameras that capture images of the stream of fiber flocks; other or additional sensors are possible. The sensor system is connected to a control unit, for example a computer. The control unit evaluates an output signal of the sensor system, applying a removal criterion to decide whether an object detected in the stream of fiber flocks is admissible or not. Depending on the result of the evaluation, it controls a separation unit to remove foreign materials from the stream of fiber flocks. The separation unit includes, for example, a plurality of compressed air nozzles that can be individually actuated by a control unit. If the control unit detects an unacceptable object, it causes the compressed air nozzle located at the position of the object to eject compressed air perpendicular to the transport direction of the stream of fiber flocks, so that the object is removed from the stream of fiber flocks.

Figure 2:
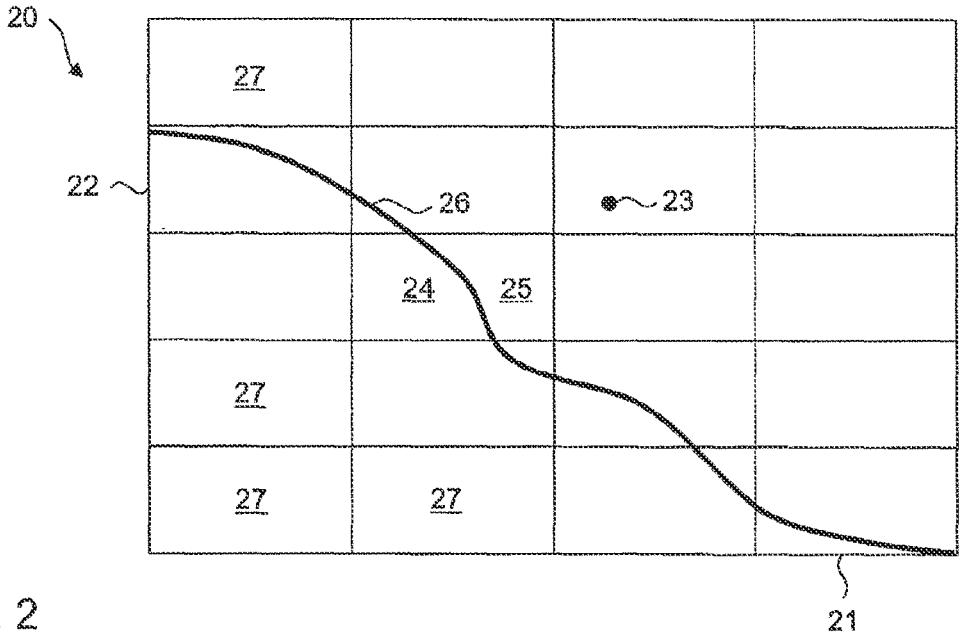
FIG. 2 shows an exemplary fiber event field for foreign material events in a stream of fiber flocks.

FIG. 2 shows a fiber event field 20 for fiber events that includes a quadrant or portion of a quadrant of a two-dimensional Cartesian coordinate system. A first parameter is plotted along a first axis, 21, such as the abscissa, and a second parameter is plotted along a second axis, 22, such as the ordinate. The first parameter may relate to a geometric property of the objects in the stream of fiber flocks and is preferably a length or area of the objects. The second parameter may relate to an optical property of the objects and is preferably an intensity of light reflected from, transmitted through, or absorbed by the flocks. The values of the first and second parameters determined for an object define coordinates of a fiber event representing the object in the fiber event field 20. In FIG. 2, for example, only one fiber event is drawn as point 23; in practice, there are many such fiber events in a stream of fiber flocks, the positions of which in the fiber event field 20 generally differ from each other.

The fiber event field 20 of FIG. 2 is divided into 20 rectangular first classes 27. In at least one, and preferably in all, of the first classes 27, the fiber events can be counted and thus their respective number determined. By forming a ratio of the absolute number of fiber events in the respective first class 27 and a total number of fiber events in the entire fiber event field 20, a relative proportion of fiber events in the respective first class 27 is determined. The first foreign material fraction may relate to only one or only some of the first classes 27.

FIG. 2 also illustrates a possible removal criterion for foreign materials in a stream of fiber flocks. The removal criterion can be given, for example, in the form of a removal curve 26 in the fiber event field 20, as described in WO-2017/190259 A1. The removal curve 26 divides the fiber event field 20 into two complementary regions: a first region 24 in which permissible fiber events are located, and a second region 25 in which impermissible fiber events are located. Objects represented by fiber events in the first region 24 remain in the stream of fiber flocks, while objects represented by fiber events in the second region 25 are eliminated from the stream of fiber flocks.

The removal curve 26 in the two-dimensional fiber event field 20, as shown in FIG. 2, is only one possible removal criterion for use in the present invention. In one embodiment, the removal criterion may consider only a single parameter, such as an intensity as plotted along the ordinate 22 of the fiber event field 20. In another embodiment, the removal criterion may consider more than two parameters, for example, a geometric property and an intensity as plotted along the axes 21, 22 of the fiber event field 20, and additionally a color of the object.

The removal criterion can be specified by an operator input, taken from a database, or calculated automatically.

The first foreign material information may be a removal rate. This may, for example, essentially indicate a number of removals per unit mass of fiber flocks (e.g., per 100 kg) or per unit time (e.g., per hour); the two indications may be converted into each other by means of the usually known mass flow per unit time (e.g., in kg/h).

At a second position in the spinning process 1 (see FIG. 1), which is located downstream with respect to the first position, yarn which has been spun from the fiber flocks is conveyed along its longitudinal direction, e.g. during rewinding 14. A yarn monitoring device 4 of the device 2 according to the invention is located at this second position. The yarn monitoring device 4 is adapted to monitor the yarn for foreign materials and, on the basis of the monitoring, to determine a second foreign material information relating to the foreign materials.

The second foreign material information may be a second foreign material fraction indicating a proportion of foreign materials in the yarn. This can be, for example, essentially a number of foreign materials per unit mass of yarn (e.g., per kg), per unit length of yarn (e.g., per 100 km), or per unit time (e.g., per hour); the three pieces of information can be converted into each other using the yarn count (e.g., in tex=g/km) or the winding speed (e.g., in m/min).

The yarn monitoring device 4 may be designed, for example, as a yarn clearer system. Yarn clearers for monitoring a running yarn for foreign materials are known per se, for example from U.S. Pat. No. 6,244,030 B1. Accordingly, the yarn monitoring device 4 includes a sensor that detects measured values of an optical measurement on a yarn section along the longitudinal direction of the yarn. It further includes an evaluation unit for determining values of a reflectivity of the measured yarn section from the measured values. The evaluation unit provides a classifying field for foreign materials, which is divided into at least two classes. It classifies the yarn events into the at least two classes and determines proportions of the yarn events in at least one of the at least two classes in a total number of the foreign materials detected in the yarn.

Figure 3:
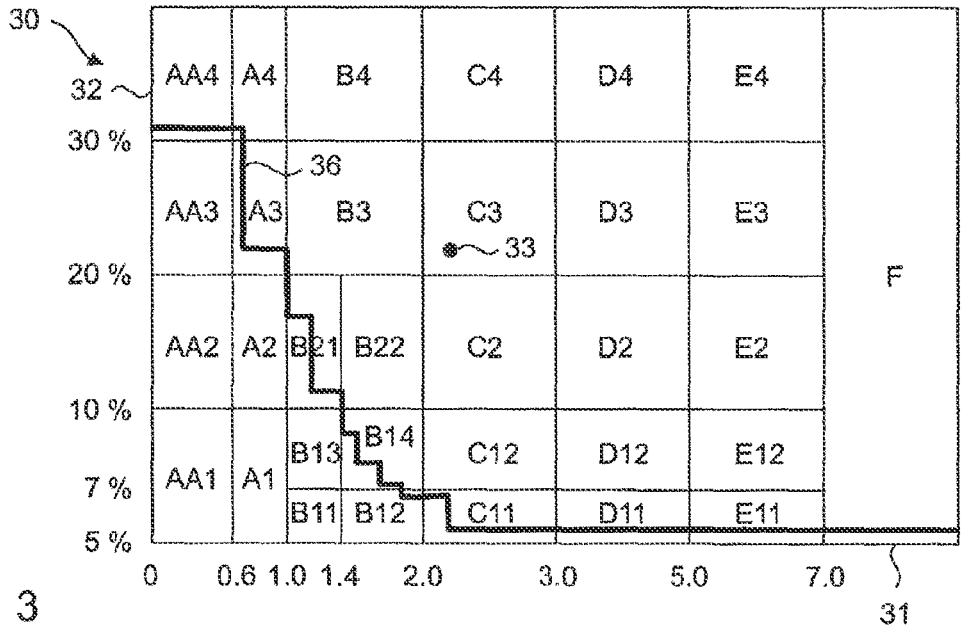
FIG. 3 shows an exemplary yarn event field for foreign material events in a yarn.

Two event fields for yarn events are given in Sec. 8.4 of the "USTER® *QUANTUM* 3 Application Handbook", Uster Technologies AG, April 2011. One of them is exemplarily shown in FIG. 3. The yarn event field 30 contains a quadrant or a part of a quadrant of a two-dimensional Cartesian coordinate system. An abscissa 31 of the coordinate system indicates an extension of reflectivity values in the longitudinal direction, for example in centimeters. An ordinate 32 indicates a deviation of reflectivity values from a nominal value, e.g. in percent. The values for the extension and the deviation of reflectivity values determined for a yarn event define coordinates of the yarn event in the yarn event field 30. In FIG. 3, only one yarn event is drawn as point 33 as an example; in practice, there are many such events in a yarn whose positions in the yarn event field 30 differ from each other.

The yarn event field 30 of FIG. 3 is subdivided into 32 rectangular second classes, which are uniquely identified by letters and numbers AA1-F. Each yarn event in yarn event field 30 can be uniquely assigned a second class AA1-F according to its location. The yarn event represented by the point 33 is in the second class C3. In at least one, and preferably in all, of the second classes AA1-F, the yarn events can be counted and thus their respective number determined. By forming a ratio of the absolute number of yarn events in the respective second class AA1-F and a total number of yarn events in the entire yarn event field 30, a relative proportion of yarn events in the respective second class AA1-F is determined. The second foreign material fraction may relate to only one or only some of the second classes AA1-F.

A clearing curve 36 is also drawn in the yarn event field 30, which represents a clearing limit as a boundary between permissible and impermissible foreign materials in the yarn. The determined coordinates of yarn events are compared with the clearing limit 36, and the yarn events are removed from the yarn, i.e. cleared out, or not, depending on the comparison.

The second foreign material information can be a clearing rate. This can, for example, essentially indicate a number of clearing operations per unit mass of yarn (e.g. per kg), per unit length of yarn (e.g. per 100 km) or per unit time (e.g. per hour); the three pieces of information can be converted into each other by means of the yarn count (e.g. in tex=g/km) or the winding speed (e.g. in m/min).

In the embodiment according to FIG. 1, the yarn monitoring device 4 is bidirectionally connected to a central control device 5, which is represented by an arrow 7. The central control device 5 is in turn bidirectionally connected to the fiber flock monitoring device 3, which is represented by an arrow 6.

The data connections 6, 7 enable a bidirectional exchange of data between the respective devices 3, 4, 5 involved. For this purpose, the fiber flock monitoring device 3, the yarn monitoring device 4 and the central control device 5 are equipped with transmitting means for transmitting data and with receiving means for receiving data. The data connections 6, 7 can be formed in a cabled or wireless manner.

The central control device 5 can be designed as an independent device, e.g. as a computer located in the spinning mill or outside the spinning mill. In this case, it includes corresponding receiving and transmitting means for receiving and transmitting data, respectively. Alternatively, the central control device 5 may be integrated in another device, e.g. in a yarn testing device in the textile laboratory of the spinning mill, in the fiber flock monitoring device 3, in the yarn monitoring device 4, etc. In the latter two cases, there may be a direct data link between the yarn monitoring device 4 and the fiber flock monitoring device 3, via which the two devices 4, 3 transmit or exchange data.

Along the connection 6 and/or 7 there may be further (not shown) devices which receive the transmitted data, process them if necessary and transmit them further. In one embodiment, a plurality of fiber flock monitoring devices 3 are connected to a fiber flock expert system. The fiber flock expert system is adapted to receive data from the fiber flock monitoring devices 3, to process them and to output them in a suitable form, and to control the fiber flock monitoring devices 3. It is in turn connected to the central control device 5. In one embodiment, a plurality of yarn monitoring devices 4 are connected to a yarn expert system. The yarn expert system is set up to receive data from the yarn monitoring devices 4, to process them and to output them in a suitable form, and to control the yarn monitoring devices 4. It is in turn connected to the central control device 5.

Figure 7A:
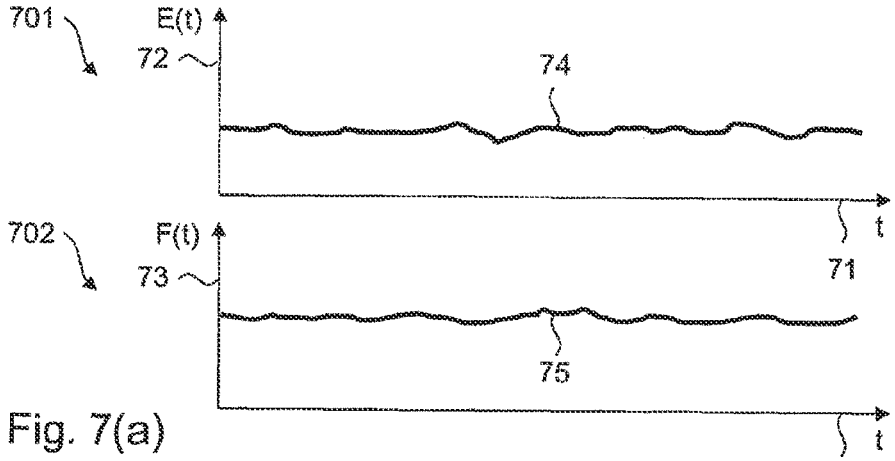
FIG. 7 shows three examples of time courses of foreign material information assigned to each other.
Figure 7B:
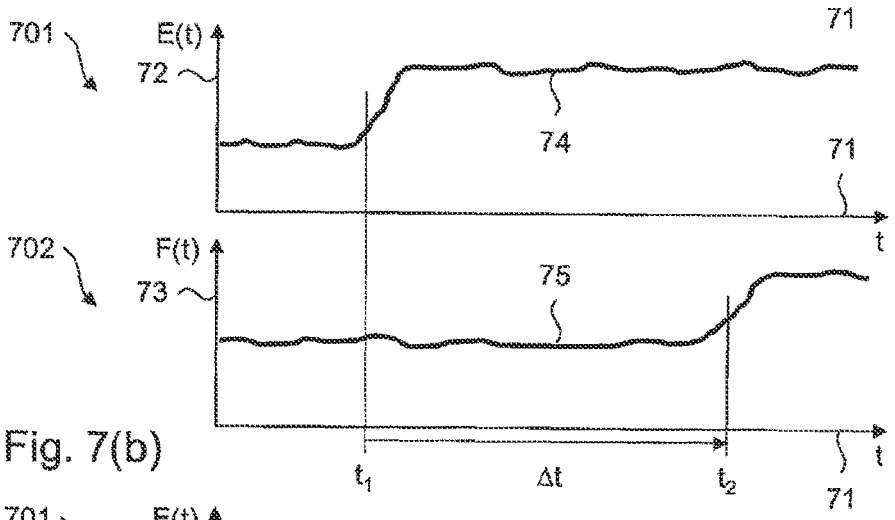
Figure 7C:
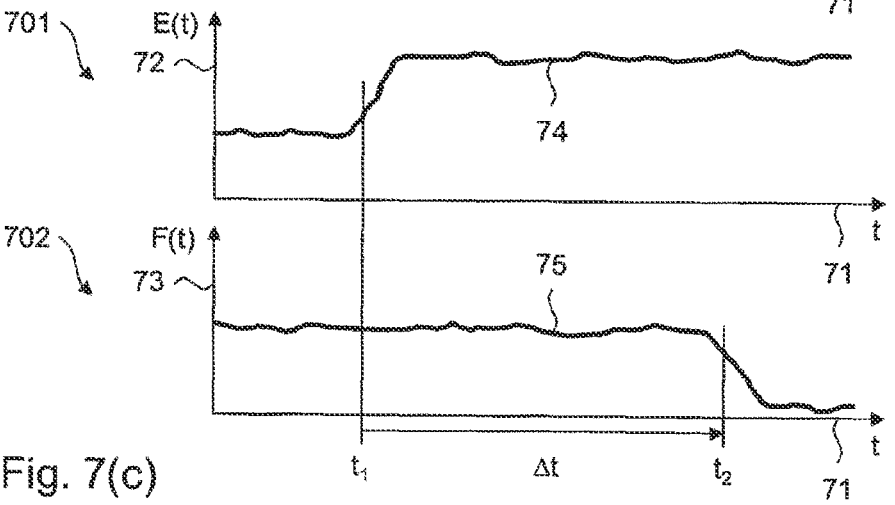

In the spinning process 1 of FIG. 1, a passage time Δt (cf. FIGS. 7(*b*) and (*c*)) is determined. The passage time Δt is defined in the present document as that time interval during which a fiber passes from the first position (e.g., fine cleaning 11) to the second position (e.g., rewinding 14) in the spinning process 1. The passage time Δt depends on several circumstances such as the spinning process 1, the organization of the spinning mill, the raw fibers, the yarn to be produced, etc. It may be in the range of hours or days, as the case may be. In one embodiment, the passage time Δt may be manually entered into the central control device 5 by an operator. In another embodiment, the passage time Δt may be calculated automatically by the central control device 5. The calculation may be performed, for example, on the basis of data stored in the central control device 5 concerning, for example, the spinning process 1, the organization of the spinning mill, the raw fibers, the yarn to be produced, etc. In a further embodiment, the passage time Δt can be retrieved by the central control device 5 on the basis of inputs from a database. It can remain constant or be changed during the execution of the method according to the invention, wherein a change can again be made manually or automatically.

In the method according to the invention, the first foreign material fraction and the second foreign material fraction refer to the same sample of fiber material, i.e. are determined "for the same fibers", so to speak. For this purpose, a second time $t_2$ (cf. FIGS. 7(*b*) and (*c*)), at which the second foreign material fraction is determined, must be after a first time $t_1$, at which the first foreign material fraction is determined, by the passage time Δt, i.e., $t_2=t_1+\Delta t$. The first foreign material fraction determined in this way and the second foreign material fraction determined in this way are assigned to each other.

The determination of the passage time Δt is only one of several possibilities for the mutual assignment of the first foreign material information and the second foreign material information. Another possibility is to determine a property of the sample itself. For example, its chemical composition can be used as a property of the sample, wherein the natural composition of the fiber by means of genetic analysis and/or an artificially added marking (marker) can play a role. Another possibility for assignment is to mark a carrier of the sample in order to track the sample in the spinning process. Depending on the nature of the sample, carriers of the sample can be cans or bobbin cores to which optical and/or electromagnetic markings are applied.

Based on the first foreign material fraction and the second foreign material fraction assigned thereto, a change is made to the spinning process 1. Some examples of such changes are presented below:

- In one embodiment, the change to the spinning process 1 includes a change to the removal criterion. For this purpose, for example, the removal curve 26 (cf. FIG. 2) can be changed.
- In one embodiment, the change to the spinning process 1 includes a change to the clearing criterion. For this purpose, for example, the clearing curve 36 (cf. FIG. 3) can be changed.
- In one embodiment, the change to the spinning process 1 includes a change to the raw fibers fed into the spinning process 1 or at least a portion thereof.
- In one embodiment, the change to the spinning process 1 includes changing settings on machines involved in the spinning process 1.

Figure 4:
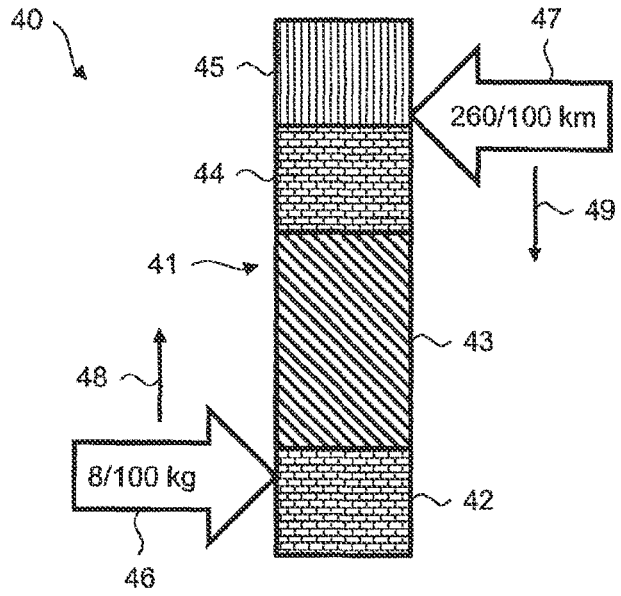
FIGS. 4 and 5 show examples of graphical outputs of associated foreign material information.
Figure 5:
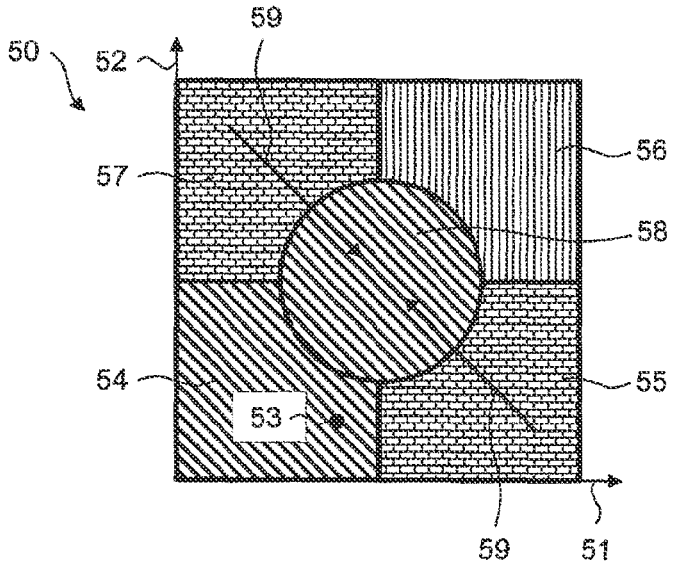

In one embodiment of the method according to the invention, the first foreign material information and the second foreign material information are output simultaneously to an operator. The simultaneous output of the first and second foreign material information is preferably done graphically. FIGS. 4 and 5 show two examples thereof, wherein the first foreign material information is the removal rate and the second foreign material information is the clearing rate.

FIG. 4 shows a first example of a graphical output 40. It contains a column 41, which is divided into four evaluation areas 42-45. On either side of the column 41 are horizontal arrows 46, 47 whose position with respect to the column 41 can be changed in the vertical direction. The left arrow 46 indicates the removal rate, the right arrow 47 the clearing rate assigned to it. The further down an arrow 46, 47 is located, the lower the rate in question is, and vice versa. For the purpose of evaluating the rates, the four evaluation areas 42-45 of column 41 may be colored in the traffic light colors green for adequate (second evaluation area 43), yellow for critical (first evaluation area 42 and third evaluation area 44) and red for highly critical (fourth evaluation area 45). In the example of FIG. 4, the removal rate is low and the clearing rate is very high. Such a disproportion of the rates is not optimal. In addition to the simultaneous output of the removal rate and the clearing rate, a recommendation for the change to the spinning process can be output to the operator. Such a recommendation is indicated in FIG. 4 by the two simple vertical arrows 48, 49: The removal rate should be increased (arrow 48) and the clearing rate should be decreased (arrow 49). In an optimal setting, both horizontal arrows 46, 47 point to the second, green evaluation area 43. It is understood that the invention includes other, similar graphical outputs, such as a separate column each for the removal rate and for the clearing rate.

FIG. 5 shows a second example of a graphical output of the removal rate and the clearing rate. This relates to a portfolio diagram 50. The removal rate is plotted along an abscissa 51 and the clearing rate along an ordinate 52. The removal rate and the assigned clearing rate form the coordinates of a point 53 in the portfolio diagram. Five evaluation areas 54-58 are schematically drawn in the diagram area, corresponding to different evaluation categories or recommendation categories. The evaluation areas 54-58 may have different shapes than those drawn in FIG. 5. For the purpose of rate evaluation, the five evaluation areas 54-58 may be colored in traffic light colors of green for adequate (first evaluation area 54 and fifth evaluation area 58), yellow for critical (second evaluation area 55 and fourth evaluation area 57), and red for highly critical (third evaluation area 56). The plotted point 53 lies in a first, green evaluation area 54. In this case, good raw fibers with low foreign material content are obviously used, so that no action is required. A point lying in a second, yellow evaluation area 55 would indicate a high removal rate with a simultaneously low clearing rate. Such a mismatch of rates should be compensated by reducing the removal rate and increasing the clearing rate. This recommendation to the operator is indicated by an arrow 59. In a third, red evaluation area 56, both the removal rate and the clearing rate are high, resulting in poor productivity. In this case, consideration should be given to using better, less contaminated raw fiber. A point located in a fourth, yellow evaluation area 57 would indicate a low removal rate with a high clearing rate. This corresponds to the situation shown in FIG. 4. Such a mismatch of rates should be compensated for by increasing the removal rate and decreasing the clearing rate. This recommendation to the operator is indicated by an arrow 59. If a point lies in the fifth, green evaluation area 58, then the removal rate and the clearing rate are balanced and the spinning process 1 does not need to be changed.

In the examples of FIGS. 4 and 5, the value of the removal rate and/or the clearing rate can be indicated in addition to the graphical representation. This is the case in FIG. 4, where the two values are entered in the corresponding horizontal arrows 46, 47. Alternatively, only the values can be output to the operator without a graphical representation.

Instead of using or in addition to arrows 48, 49 (FIG. 4) or 59 (FIG. 5) or similar graphic symbols, the recommendation may be given to the operator in words.

In the highly critical cases (fourth evaluation area 45 of FIG. 4 and third evaluation area 56 of FIG. 5), preferably not only a recommendation but also a warning or alarm is issued to the operator. This can be done graphically or with words on a display unit of the central control unit 5 (FIG. 1), acoustically and/or visually, e.g. with a warning light.

Based on the graphical output, the recommendation and/or the alarm, the operator can make a change to the spinning process 1 manually. Alternatively, the change to the spinning process 1 can be made automatically, e.g. by the central control unit 5 (FIG. 1).

The boundaries of the evaluation areas 42-45, 54-58 in FIGS. 4 and 5 can be specified in several ways. A first possibility is a default based on experience. A second possibility is to determine in advance a worldwide frequency distribution of a foreign material content in fiber flocks and/or in yarns and to take this frequency distribution into account when determining the limits of the evaluation areas. Such a worldwide frequency distribution can be taken from the USTER® *STATISTICS*, for example. The USTER®*STATISTICS* are a compilation of textile quality data published by the applicant of the present IP right, determined from the worldwide production of textile raw materials, intermediates and finished products; see https://www.uster.com/en/service/uster-statistics/, retrieved at the filing date of the present IP right.

Figure 6:
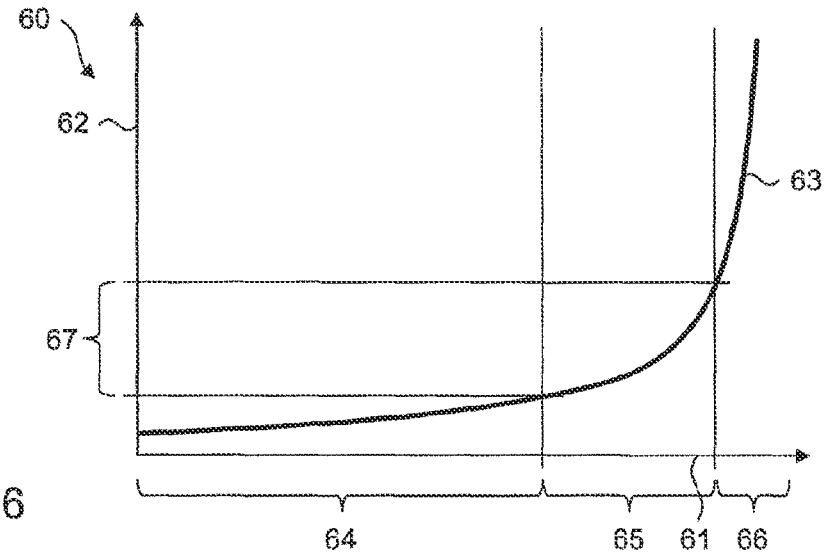
FIG. 6 shows a diagram that can be used to define boundaries of evaluation areas for foreign material information.

Another possibility for defining the boundaries of the evaluation areas 42-45, 54-58 in FIGS. 4 and 5 is illustrated in FIG. 6. The figure shows a diagram 60 in a Cartesian coordinate system, along the abscissa 61 of which a parameter influencing the removal criterion is plotted. This parameter may be, for example, a sensitivity of the fiber flock monitoring device 3 (FIG. 1) with respect to light intensity, which determines the position of the removal curve 26 (FIG. 2) in the vertical direction. Along the ordinate 62 the removal rate is plotted. A curve 63 indicates the correlation between the sensitivity and the removal rate. Such a correlation can be determined heuristically or theoretically in advance. The abscissa 61 is divided into three areas 64-66. In a first area 64, the sensitivities are so low that they have little effect on the removal rate. In a third area 66, the sensitivities are very high, resulting in very high removal rates. In a second area 65, there are medium sensitivities with medium removal rates. An area 67 of the removal rate corresponding to this second area 65 corresponds to the appropriate green area 43 of the removal rate in FIG. 4. Similarly, an appropriate area can be defined for the purification rate.

FIG. 7 shows three examples of time courses of the first foreign material information and the second foreign material information assigned to it. These two pieces of foreign material information are each shown in two diagrams 701, 702 arranged one above the other, wherein the upper diagram 701 along an ordinate 72 indicates, for example, a removal rate E(t) and the lower diagram 702 along an ordinate 73 indicates a second piece foreign material fraction F(t) and the abscissa 71 is the time axis t common to both diagrams 701, 702. A first curve 74 in the upper diagram 701 indicates the time course of the first foreign material information, a second curve 75 in the lower diagram 702 indicates the time course of the second foreign material information. It is assumed that apart from a possible change in the removal criterion, no other changes are made to the spinning process 1. The examples show the expected behavior in each case. A deviation from this behavior indicates a fault in the spinning process 1 and can, for example, trigger an alarm to the operator.

FIG. 7(*a*) shows the trivial case in which the removal rate E(t) remains constant in time and the removal criterion is not changed. In this case, the second foreign material fraction F(t) should also remain constant in time; otherwise, an alarm should be issued.

In the example of FIG. 7(*b*), a higher removal rate E(t) is observed at a first time $t_1$ without the removal criterion having been changed. This may be the case when raw fibers with more foreign materials are fed into the spinning process 1. It is expected that at a second time $t_2$, which is later than the first time $t_1$ by the passage time Δt, the second foreign material fraction F(t) will also increase. Conversely, without changing the removal criterion, a decrease in the removal rate E(t) should also result in a decrease in the second foreign material fraction F(t).

In the example of FIG. 7(*c*), the removal criterion is changed at a first time $t_1$ so that a higher removal rate E(t) results. As expected, this should have the consequence that at a second time $t_2$, which is later than the first time $t_1$ by the passage time Δt, the second foreign material fraction F(t) decreases. If, on the other hand, the removal criterion is changed in such a way that a lower removal rate E(t) results, the second foreign material fraction F(t) should increase later by the passage time Δt.

Figures 8A, 8B, 8C:
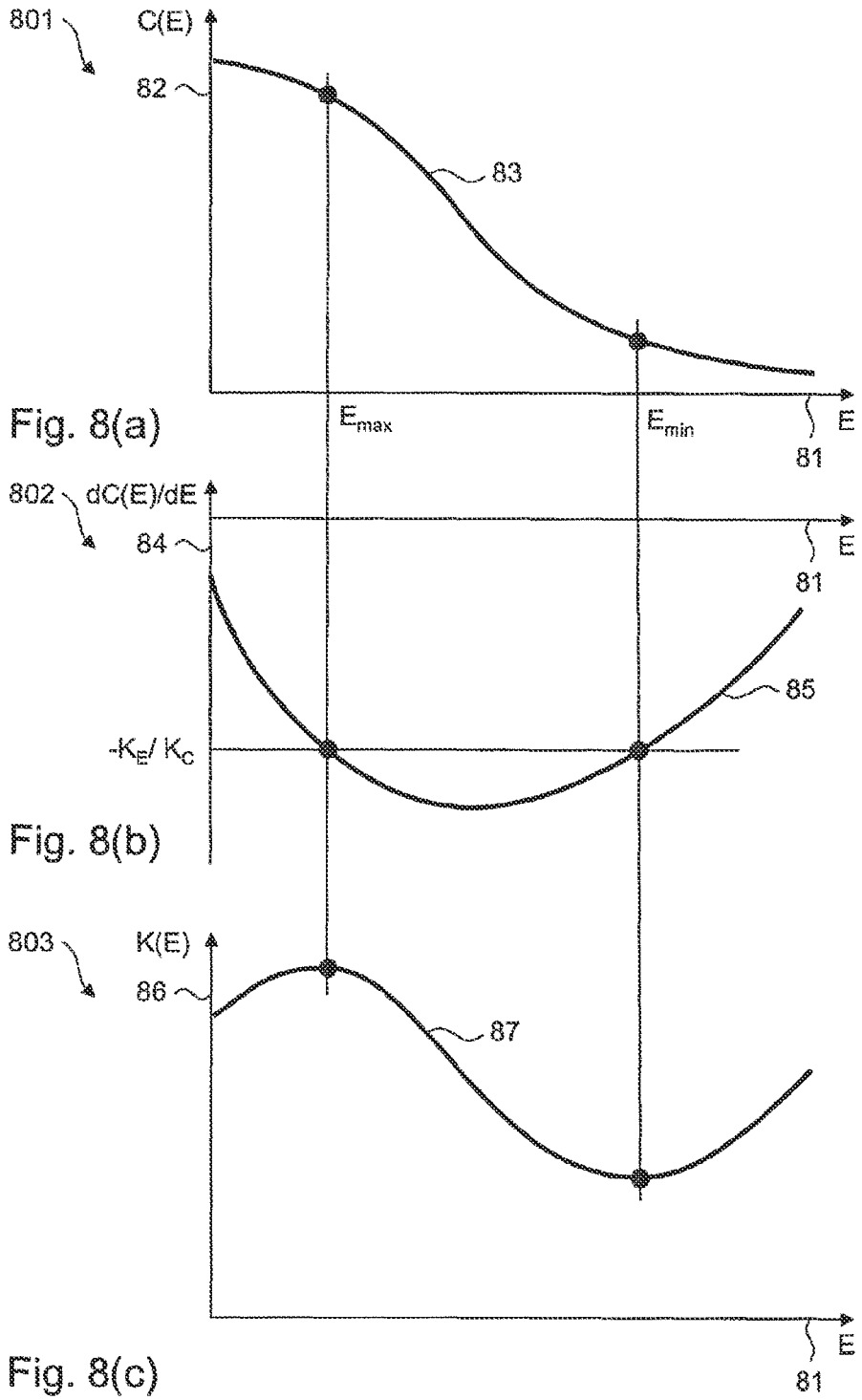
FIG. 8 shows diagrams for minimizing costs in a spinning process.

FIG. 8 illustrates a further embodiment of the method according to the invention. In this embodiment, costs are also taken into account.

FIG. 8(*a*) shows a diagram 801 in a Cartesian coordinate system, along whose abscissa 81 the removal rate E and along whose ordinate 82 the clearing rate C(E) are plotted. A curve 83 schematically shows a possible correlation between the removal rate E and the clearing rate C(E). Such a correlation C(E) can be determined heuristically or theoretically. Also heuristically or theoretically, the cost $K_E$ for a removal and the cost $K_C$ for a clearing operation can be determined. The total costs K per unit mass for the removals and clearing operations in spinning process 1 are then as follows $$K(E)=E\cdot K_E+C(E)K_C,$$

wherein it is important to see that the removal rate E and the clearing rate C refer to the same unit mass in this linear combination. The condition for minimizing the total cost K(E) is as follows:

$$\frac{dK}{dE}=K_E+\frac{d}{dE}C(E)\cdot K_C=0.$$

From this follows $$\frac{d}{dE}C(E)=-\frac{K_E}{K_C}.$$

Accordingly, in a diagram 802 in FIG. 8(*b*) the derivative dC(E)/dE of the curve 83 of FIG. 8(*a*) is plotted along an ordinate 84. A curve 83 shows the course of the derivative. As an example, a value $-K_E/K_C$ is plotted which the derivative assumes at two locations $E_{max}$, $E_{min}$.

Finally, in a diagram 803 in FIG. 8(*c*), the total costs K(E) are plotted by means of a curve 87. A maximum of the total costs K(E) to be avoided is located at a first location $E_{max}$ of the two locations mentioned. At a second location $E_{min}$ of the mentioned two locations, however, lies the minimum, which is of interest here. This value $E_{min}$ should be aimed at by an appropriate choice of the removal criterion in order to optimize the spinning process 1. Thus, in this embodiment, the change to the spinning process 1 should consist in such a choice of the removal criterion that the removal rate is just $E_{min}$; then the total cost K(E) is minimal. The change can be made manually by an operator or automatically, e.g. by the central control unit 5 (FIG. 1).

The embodiment of the method according to the invention described on the basis of FIG. 8 can be carried out even if the function shown in FIG. 8(*a*) cannot be determined or cannot be determined completely for a given spinning process 1. It is sufficient if a single point (E, C') is known for the given spinning process 1 and the function C(E) for another but similar spinning process. Assuming that the courses of curve 83 are similar for both spinning processes, a proportionality factor $$p=\frac{C'(E)}{C(E)}$$

can be calculated. The minimum condition for the given spinning process 1 is then $$\frac{d}{dE}C(E)=-\frac{1}{p}\cdot\frac{K_E}{K_C},$$

wherein dC(E)/dE is the derivative of the known function C(E) shown in FIG. 8(*b*).

As used herein, the phrase "at least one of A, B, and C" means all possible combinations of none or multiple instances of each of A, B, and C, but at least one A, or one B, or one C. For example, and without limitation: Ax1, Ax2+Bx1, Cx2, Ax1+Bx1+Cx1, Ax7+Bx12+Cx113. It does not mean Ax0+Bx0+Cx0.

It is understood that the present invention is not limited to the embodiments discussed above. In particular, foreign material information relating to the foreign materials may be determined at more than two positions in the spinning process. With knowledge of the invention, the person skilled in the art will be able to derive other variations which are also within the scope of the present invention.

LIST OF REFERENCE NUMERALS

1 Spinning process
11 Fine clearing
12 Carding
13 Spinning
14 Rewinding
2 Device
3 Fiber flock monitoring device
4 Yarn monitoring device
5 Central control device
6, 7 Data connections
20 Fiber event field
21 Abscissa

22 Ordinate
23 Fiber event
24 First region for permissible fiber events
23 Second region for unacceptable fiber events
26 Removal curve, removal criterion
27 Classes of fiber events
30 Yarn event field
31 Abscissa
32 Ordinate
33 Yarn event
40 Graphical output
41 Column
42-45 Evaluation areas
46 Arrow for displaying the removal rate
47 Arrow for displaying the clearing rate
48, 49 Arrows for displaying recommendations
50 Portfolio diagram
51 Abscissa
52 Ordinate
53 Point in portfolio diagram
54-58 Evaluation areas
59 Arrows for displaying recommendations
60 Diagram
61 Abscissa
62 Ordinate
63 Curve
64-66 Areas on the abscissa
67 Area on the ordinate
701, 702 Diagrams
71 Abscissa
72, 73 Ordinates
74, 75 First and second curve, respectively
801-803 Diagrams
81 Abscissa
82, 84, 86 Ordinates
83, 85, 87 Curves

The invention claimed is:

1. A method for optimizing a spinning process, through which a fiber material fed in the form of raw fibers and output in the form of yarn passes, with respect to foreign materials in the fiber material, wherein:

at a first position in the spinning process, a stream of fiber flocks pneumatically conveyed in an air stream is monitored for foreign materials, foreign materials are eliminated from the stream of fiber flocks according to a removal criterion, and, based on the monitoring, first foreign material information relating to the foreign materials is determined, wherein the first foreign material information is a removal rate (B) that substantially indicates a number of removals per unit mass of fiber flocks or per unit time, at a second position in the spinning process, yarn which has been spun from the fiber flocks and is conveyed along its longitudinal direction is monitored for foreign materials, foreign materials detected in the yarn are cleared out of the yarn according to a clearing criterion, and based on the monitoring, a second foreign material information relating to the foreign materials is determined, wherein the second foreign material information is a clearing rate (C) that substantially indicates a number of clearing operations per unit mass of yarn, per unit length of yarn, or per unit time, a passage time (Δt) is determined as that time interval during which a fiber passes from the first position to the second position in the spinning process, the first foreign material information is determined at a first time ($t_1$) and the second foreign material information is determined at a second time ($t_2$) which is after the first time ($t_1$) by the passage time (Δt), the first foreign material information thus determined and the second foreign material information thus determined are assigned to each other such that they relate to substantially the same sample of the fiber material, a change is made to the spinning process on the basis of the first foreign material information and the second foreign material information assigned thereto, wherein the change to the spinning process includes a change to the removal criterion and/or a change to the clearing criterion, and a product of costs ($K_E$) for a removal determined in advance and of the removal rate (E) is taken into account in the change to the spinning process, and/or a product of the costs ($K_C$) for a clearing operation determined in advance and of the clearing rate (C) is taken into account in the change to the spinning process.

2. The method according to claim 1, wherein the change to the spinning process takes into account a linear combination of the product of the cost ($K_E$) for a removal and the removal rate (E), and the product of the cost ($K_C$) for a clearing operation and the clearing rate (C).

3. The method according to claim 2, wherein the change is made to the spinning process such that the linear combination assumes a smaller value after the change than before the change.

4. The method according to claim 1, wherein the passage time (Δt) is at least one of entered manually by an operator, calculated automatically based on defaults, and retrieved from a database based on specifications.

5. The method according to claim 1, wherein at least one of:

first classes of foreign materials are predetermined in the fiber material at the first position, which first classes differ from each other with respect to properties of the foreign materials, and the first foreign material information relates to one or more of these first classes, and, second classes (AA1-F) of foreign materials in the fiber material are predetermined at the second position, which second classes (AA1-F) differ from each other with respect to properties of the foreign materials, and the second foreign material information relates to one or more of these second classes (AA1-F).

6. The method according to claim 1, wherein the first foreign material information and the second foreign material information are output simultaneously to an operator.

7. The method according to claim 6, wherein the simultaneous output of the first foreign material information and the second foreign material information occurs at least partially graphically.

8. The method according to claim 6, wherein in addition to simultaneously outputting the first foreign material information and the second foreign material information, an evaluation of at least one of the first foreign material information and the second foreign material information is output to the operator.

9. The method according to claim 8, wherein the evaluation includes at least two categories each indicative of appropriate and critical foreign material information, respectively.

10. The method according to claim 6, wherein in addition to simultaneously outputting the first foreign material information and the second foreign material information, a recommendation for the change to the spinning process is output to the operator.

11. The method according to claim 1, wherein an alarm is issued to an operator based on the first foreign material information and the second foreign material information assigned thereto.

12. The method according to claim 11, wherein a time course of the first foreign material information and a time course of the second foreign material information assigned thereto are determined, and the alarm is output based on the time courses.

13. The method according to claim 1, wherein the change is made to the spinning process automatically.

14. The method according to claim 1, wherein a global frequency distribution of a foreign material content in fiber flocks and/or in yarns is determined in advance and this frequency distribution is taken into account in the change to the spinning process.

15. A device for carrying out the method according to claim 1 in a spinning mill carrying out a spinning process through which a fiber material fed in the form of raw fibers and discharged in the form of yarn passes, comprising:

a fiber flock monitoring device at a first position in the spinning process, adapted to, monitor a stream of fiber flocks pneumatically conveyed in an air flow for foreign materials, eliminate for materials from the stream of fiber flocks according to a removal criterion, and determine the first foreign material information on the basis of the monitoring, wherein the first foreign material information is a removal rate (E) that substantially indicates a number of removals per unit mass of fiber flocks or per unit time, a yarn monitoring device at a second position in the spinning process located downstream with respect to the first position, adapted to, monitor yarn spun from the fiber flocks and conveyed along its longitudinal direction for foreign materials, clear out of the yarn foreign materials detected in the yarn according to a clearing criterion, and determine the second foreign material information on the basis of the monitoring, wherein the second foreign material information is a clearing rate (C) that substantially in indicates a number of clearing operations unit mass of yarn, per unit length of yarn, or per unit time, and a central control device connected to the first monitoring device and the second monitoring device, which is adapted for the purpose of, storing a passage time ($\Delta t$) as that time interval during which a fiber passes from the first position to the second position in the spinning process, storing the first foreign material information at a first time ($t_1$) and the second foreign material information at a second time ($t_2$) which is after the first time ($t_1$) by the passage time ($\Delta t$), assigning the first foreign material information thus determined and the second foreign material information thus determined to each other such that they relate to substantially the same sample of the fiber material, and making a change to the spinning process automatically on the basis of the first foreign material information and the second foreign material information assigned thereto, wherein the change to the spinning process includes a change to the removal criterion and/or a change to the cleaning criterion, and taking into account a product of costs ($K_E$) for a removal determined in advance and of the removal rate (E) in the change to the spinning process, and/or taking into account a product of the costs ($K_C$) for a clearing operation determined in advance and of the clearing rate (C) in the change to the spinning process.

* * * * *